US006932307B2

(12) United States Patent
Guennec et al.

(10) Patent No.: US 6,932,307 B2
(45) Date of Patent: Aug. 23, 2005

(54) SATELLITE ANTENNA HOLDER

(75) Inventors: Alain Guennec, Sambourg (FR); Sébastien Bonnet, Soyaux (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/666,233

(22) Filed: Sep. 18, 2003

(65) Prior Publication Data

US 2004/0069915 A1 Apr. 15, 2004

(30) Foreign Application Priority Data

Sep. 20, 2002 (EP) ..... 02292308

(51) Int. Cl.[7] ..... E04G 3/00

(52) U.S. Cl. ..... 248/219.2; 248/278.1; 343/882

(58) Field of Search ..... 248/219.2, 218.4, 248/278.1; 343/892, 765, 882

(56) References Cited

U.S. PATENT DOCUMENTS 3,510,877 A * 5/1970 Turriere ..... 343/760
6,045,103 A 4/2000 Costa et al. ..... 248/278.1
6,211,845 B1 4/2001 Cook et al. ..... 343/882
6,317,093 B1 11/2001 Harris ..... 343/765

FOREIGN PATENT DOCUMENTS

DE 3127855 A1 * 6/1983
EP 0038788 10/1981
EP 268125 * 10/1987
GB 2226705 A 7/1990

OTHER PUBLICATIONS

Patent Abstracts of Japan, vol. 1996, No. 3, Mar. 29, 1996 & JP 07 307606 of Nov. 21, 1995.
Patent Abstracts of Japan, vol. 1998, No. 09, Jul. 31, 1998 & JP 10 107524 of Apr. 24, 1998.
Patent Abstracts of Japan, vol. 011, No. 152, May 16, 1987 & JP 61 288502A of Dec. 18, 1986.
European Search Report of Oct. 29, 2002.

* cited by examiner

*Primary Examiner*—Ramon O Ramirez
(74) *Attorney, Agent, or Firm*—Joseph S. Tripoli; Harvey D. Fried; Patricia A. Verlangieri

(57) ABSTRACT

An adjustable satellite antenna holder has a first base member, a first coarsely adjustable support member pivotable about a first axis with respect to the first base member and a first finely adjustable support member pivotable about an axis parallel to said first axis with respect to the first coarsely adjustable support member.

20 Claims, 5 Drawing Sheets

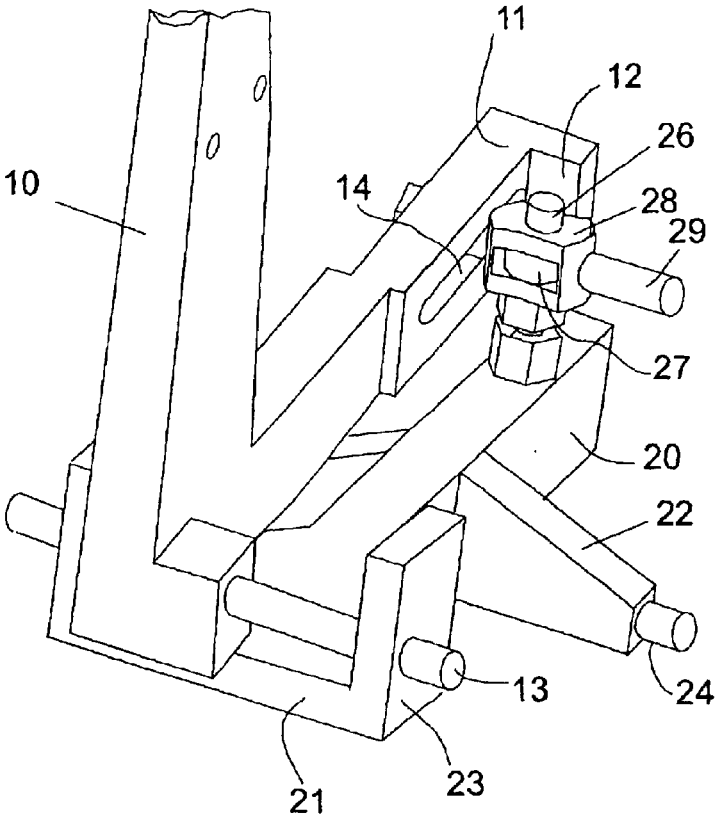
Fig. 2
Fig. 3
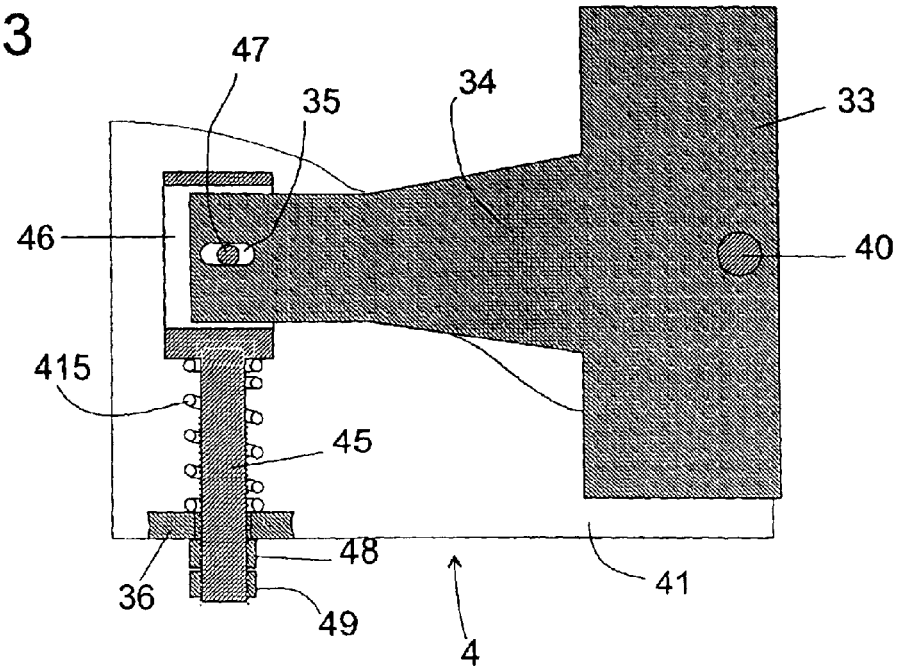

SATELLITE ANTENNA HOLDER

FIELD OF THE INVENTION

The invention relates to a satellite antenna holder.

BACKGROUND OF THE INVENTION

Satellite antennas, in particular parabolic antennas popularly referred to as "satellite dishes" have come into widespread use with the advent of satellite-based television. Such satellite dishes are known to require careful alignment in order to achieve a good reception performance. In order to allow for elevation and azimuth alignment of such antennas, in particular of antennas for private household use, simple antenna holders have been designed in which e.g. a ball-and-socket joint ensured to degrees of rotational freedom. In an unlocked state of this joint, the dish was pivoted free-handedly until an appropriate alignment was found, and then the joint was locked in order to fix the dish in this alignment.

Forthcoming applications such as interactive television, high speed internet access by satellite etc. will require small and economic satellite antenna designs which enable a user not only to receive a downlink signal from the satellite, but also to transmit data in the uplink direction, towards the satellite.

For uplink transmission, the alignment of the satellite antenna with respect to the satellite is much more critical than for downlink. This is because the receiving characteristic of the satellite dish on earth, being very narrow and aimed at the satellite, receives very little noise besides the signal from the satellite, whereas a satellite antenna that must be able to receive uplink signals from numerous satellite dishes at various places on earth is exposed to a much higher level of noise. Therefore, it is expected that for bi-directional applications, earthborn satellite antennas will have to be aligned with an accuracy of approximately 0.1 degrees. This is a level of precision which is not reliably achieved with the conventional satellite dish holders described above.

SUMMARY OF THE INVENTION

It is therefore desirable to design a simple and economical satellite holder that can be aligned quickly and with a high degree of precision.

The invention proposes an adjustable satellite antenna holder comprising a first base member, a first coarsely adjustable support member pivotable about a first axis with respect to the first base member and a first finely adjustable support member pivotable about an axis parallel to said first axis with respect to the first coarsely adjustable support member.

When the first base member of the antenna holder is mounted on an appropriate substructure and the satellite antenna is mounted to its first finely adjustable support member, a quick and rough adjustment can simply be done by turning the first coarsely adjustable support member until a downlink signal from a desired satellite is received, and then using the finely adjustable support member for a fine alignment. Whereas the coarsely adjustable support member may simply be a joint rotated by hand, as in the prior art, the finely adjustable support member will preferably comprise an adjusting actuator by which small rotations in the range of 0.1 to 1 degree can be reliably and reproducibly driven.

For adjustment in elevation and azimuth directions, a two-stage construction may be used in which the first base member and support members are for adjustment of one rotational degree of freedom, and a second stage comprising a second base member, a second coarsely adjustable support member and a second finely adjustable support member is provided for the second rotational degree of freedom. Here, the first base member is rigidly coupled to the second finely adjustable support member; in particular, they may be formed by a unitary element.

The second support member need not be integrated into a single device together with the other members; it may e.g. be a pole or another type of appropriate substructure to which the satellite antenna holder is mounted, a coarse adjustment between the pole and the second coarsely adjustable support member being done at mounting time.

The adjusting actuator should preferably be designed so as to lock the support members coupled by it relative to each other when it is not driven. Such an actuator may simply comprise a screw and a nut that can be rotated with respect to each other, a pneumatic or hydraulic piston, a motorized translation stage, etc.

According to a first group of preferred embodiments of the invention, the actuator comprises a screw mounted to one of said support members and a nut rotatably mounted to the other support member and engaging the screw. In a first embodiment of this group, the screw is rigidly held at said one support member and the nut is coupled to a cross-bar that engages said other support member and is gradually displaceable therein with respect to the pivoting axis. Alternatively, the screw may be gradually displaceably engaged with said one support member, and the other support member to which the nut is rotatably mounted comprises guiding means for guiding the screw in its longitudinal direction.

According to a second preferred embodiment, the actuator is also formed of a screw, and this screw has a circumferential profile, preferably a circumferential groove near the head of the screw, which is rotatably engaged with one of said support members, the threaded portion of the screw engaging a threaded bore of said other support member. The portion of said one support member engaging the groove preferably has a circular cross section, so that it can freely tilt within the groove when the support members are pivoted with respect to each other.

Additionally, the screw should be equipped with a locking nut for locking the screw once a properly aligned position has been found.

According to another embodiment, the actuator comprises two screws mounted in threaded bores of one of said support member in such a way that the tips of these screws face each other, and a trunnion of said other support member extending between the tips. When the tips of the two screws are far apart from each other, the two support members may be freely rotated with respect to each other by hand, until the trunnion hits one of the two tips. A fine adjustment can be carried out by reducing the space between the tips to a minimum and rotating both screws and synchronism, so that one tip pushes the trunnion while simultaneously, the other tips recedes. This type of actuator is particularly suitable for azimuth adjustment.

In order to readily achieve the desired accuracy of adjustment, one should preferably choose the pitch of the screw(s) such that one turn of the screw(s) corresponds to a rotation of the finely adjustable support member of less than 0.5°. In order to make the adjustment procedure not more tedious than necessary, the rotation of the finely adjustable support member per turn of the screw should be at least 0.1°.

There should preferably be means for fixing the base and support members with respect to each other after adjustment. In particular, if there are two degrees of rotational freedom to be adjusted, it is important to fix one before adjusting the other. Of course, when fixing the base and support members to each other, care must be taken not to induce a movement that would destroy the adjustment. For this purpose, a very advantageous locking means is an eccentric mounted on a shaft defining the axis of rotation, the eccentric being pivotable between a locking position in which it urges said members into a frictional engagement and an unlocking position in which said frictional engagement is released. Since the eccentric is mounted close to the axis of rotation, any torque it might exercise when locking is very small. In particular, if the eccentric comes into contact with one of said members of both sides of the shaft, frictional forces exercised on these two sides tend to compensate each other.

As an additional locking means, a base member may be provided with a circular slot centred around its axis of rotation, and the coarsely adjustable support member that is pivotable around this axis of rotation has a threaded portion extending through the slot which may be fixed to the slot using a nut. This type of fixing means is particularly appropriate for fixing when a coarse adjustment for one degree of freedom has been carried out and before the fine adjustment is begun. A slight pivoting movement of the coarsely adjustable support member which may be caused by fixing the screws may afterwards be compensated during fine adjustment.

BRIEF DESCRIPTION OF THE DRAWINGS

Further objects, features and advantages of the invention will become apparent from the subsequent description of preferred embodiments given with respect to the appended drawings.

FIG. 2 shows part of the same holder under a different angle and especially the fine elevation adjusting mechanism;

FIG. 3 shows a cross section of the azimuth fine adjusting mechanism of the holder of FIG. 1;

DETAILED DESCRIPTION OF PREFERRED EMBODIMENTS

Figure 1:
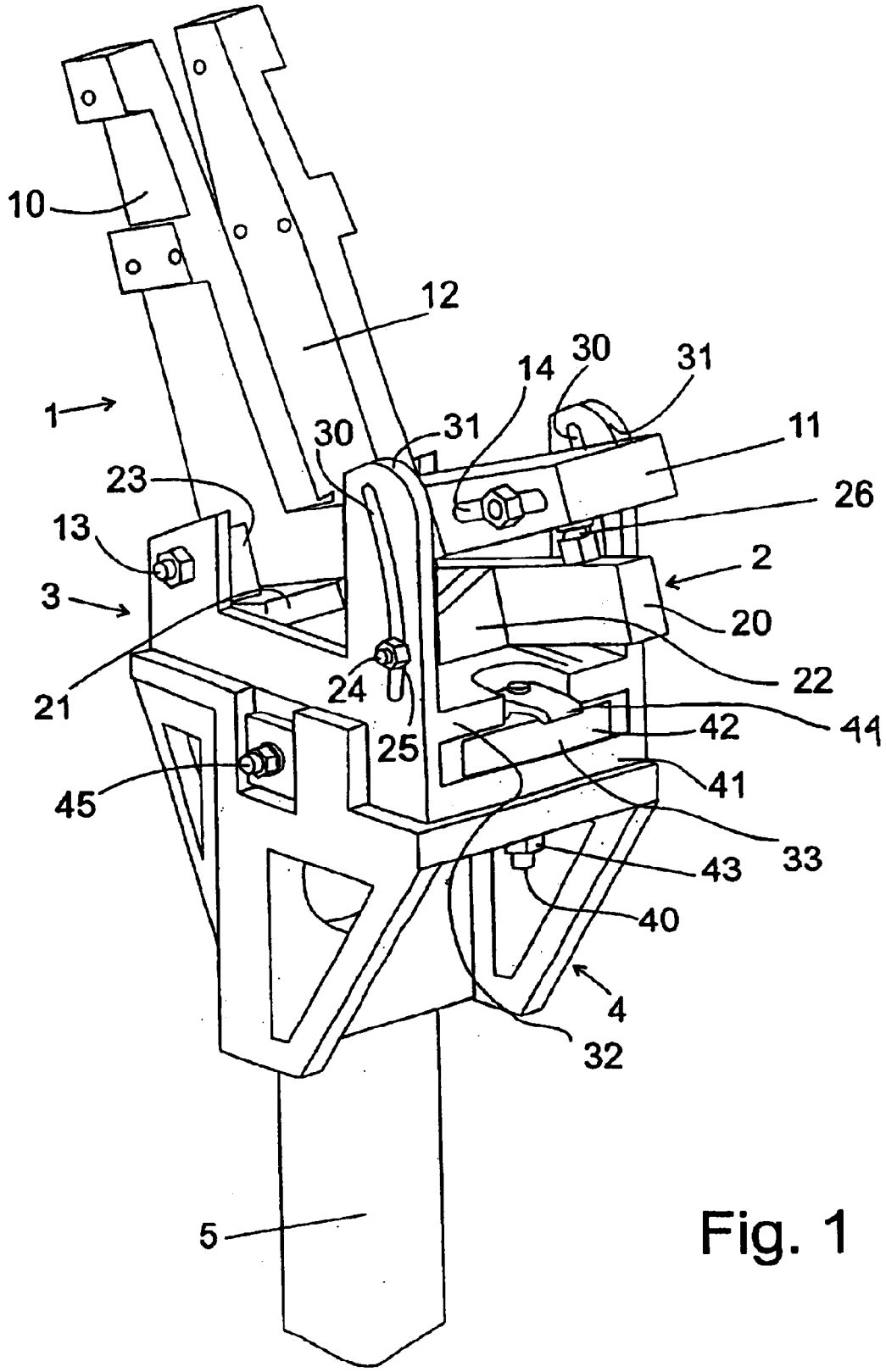
FIG. 1 is a perspective view of a satellite antenna holder according to a first embodiment of the invention having azimuth and elevation adjusting mechanisms.

The holder shown in FIG. 1 comprises a first finely adjustable support member 1 which is approximately in the shape of the letter L. It has an approximately vertical branch 10 and an approximately horizontal branch 11. A slot 12 extends through all of branch 10 and most of branch 11. A cylindrical rod 13 extends through a bore which is formed at the angle between branches 10, 11 of first finely adjustable support member 1 and is held in a first base member 3.

A first roughly adjustable support member 2 is also rotatably mounted to the rod 13. The roughly adjustable support member 2 is formed of a rod 20 of rectangular cross section bearing two crossbars 21 and 22. As is best seen in FIG. 2, the crossbar 21 has two upturned end portions 23 in which holes are formed through which the cylindrical rod 13 rotatably extends.

It should be noted that in FIG. 2 only a left hand portion of the first finely adjustable support member 1 is shown, the portion to the right of slot 12 is not represented in order to allow a view of adjusting means 26 to 29 that will be explained in detail below.

The other crossbar 22 has threaded end portions 24 that extend through slots 30 formed in vertical side wings 31 of first base member 3 and may be fixed to the base member 3 in a given position by means of nuts 25. The slots 30 are in the shape of circle sectors that extend concentrically around the cylindrical rod 13.

A threaded bolt 26 extends perpendicularly from the surface of the rod 20 into the slot 12 of branch 11. It extends through a bore (not shown) of rod 20 and is fixed to the rod 20 by means of locking nuts at the upper and lower sides of rod 20, only the upper one of which is shown in the FIG. The threaded bolt 26 bears a knurled nut 27 held in a cage 28. The cage 28 has openings through which the nut 27 can be rotated by a user's fingers, whereby the cage 28 is displaced up and down along the threaded bolt 26. The cage 28 has two laterally extending arms 29 that engage slits 14 symmetrically formed in the left-hand and right-hand portions of branch 11 of first finely adjustable support member 1.

The members 1, 2, 3 form an elevation adjusting mechanism of the antenna holder. Adjustment is carried out by first roughly setting the orientation of roughly adjustable support member 2 with respect to base member 3. This can be done by tilting member 2 by hand until a weak satellite signal is received by an antenna mounted on branch 10, or by setting the angle between base member 3 and roughly adjustable support member 2 to a predefined value, for example by inserting a template between the rod 20 and a base plate 32 of support member 3, adapting the angle between the two to the template and fixing the roughly adjustable support member 2 using the nuts 25.

A fine adjustment is then carried out by setting the position of finely adjustable support member 1 with respect to roughly adjustable support member 2 by rotating the nut 27 until optimal receiving conditions are achieved. The pitch of threaded bolt 26 is set such that the bolt 26 is self-locking, i.e. that pressure exercised on the support members will not cause the bolt 26 to rotate. Specifically, the pitch should be such that one turn of the nut 27 corresponds to a rotation of the finely adjustable support member 1 of approximately 0.1° to 0.5° if a beam opening angle of 0.1° is assumed for the satellite at which the antenna is directed.

The base plate 32 forms a second finely adjustable support member for an azimuth adjusting mechanism. This mechanism further comprises a pole 5 forming a second base member and a pole adaptor 4 forming a second roughly adjustable support member. The pole 5 is cylindrical in cross section, and the pole adaptor 4 has a mounting socket which is not shown in detail in FIG. 1, in which an end portion of the pole 5 may be inserted and fixed by pressing the pole 5 in an arbitrary azimuth orientation.

The base member 3 is rotatable with respect to the pole adaptor 4 around a bolt 40. This bolt 40 extends through two plate members 41, 42 of pole adaptor 4 and, between these two, through a bar 33 which is part of base member 3. At one end of the bolt 40, there is a nut 43 in contact with the lower one 41 of the two plate members, at the other there is an eccentric lever 44. In the position shown in FIG. 1, the lever 44 is in a downturned, locked position in which it holds the plate members 41,42 pressed against the bar 33, so that no azimuth rotation of the base member 3 with respect to the pole adaptor 4 is possible. In an unlocked, upturned position of lever 44, the plate members 41, 42 and the bar 33 come apart and can be rotated. Since this locking mechanism is located at the axis of azimuth rotation of the antenna holder, any force exercised on the locking lever 44 cannot generate a torque in the azimuth direction. Moreover, since the bar 33 is sandwiched between the plate members 41,42, the base member can not be rotated by frictional forces that may occur when the lever 44 is rotated between its locked and unlocked positions. In this way, when an adjustment of the azimuth orientation of the antenna has been carried out, it will not be destroyed by locking the lever 44.

A mechanism for finely adjusting the azimuth orientation of the antenna is concealed inside the holder. In FIG. 1, only part of a threaded bolt 45 for driving this adjusting mechanism can be seen. The mechanism as such will therefore be described referring to FIG. 3. This FIG. is a partial horizontal section through the holder of FIG. 1 at the level of bar 33. This bar 33 has a projection 34 extending backwards into the holder. At an end portion of the projection 34, a slightly elongated hole 35 is formed. The end portion extends into a box 46 rigidly coupled to the end of threaded bolt 45. A pin 47 firmly held in walls of the box 46 extends through the hole 35. The threaded bolt 45 extends though an opening in a side wall 36 of base member 3. A compression spring 415 extending around threaded bolt 45 urges the box 46 away from the side wall 36, so that a nut 48 held by the threaded bolt 45 is always firmly pressed against the outside of wall 36. By turning the nut 48, the bar 33 may be turned in either direction around the axis defined by bolt 40, whereby a fine adjustment of the azimuth angle of the antenna is achieved.

Once a satisfying adjustment of the azimuth angle has been found, it may be fixed using a locking nut 49.

Here, again, the pitch of bolt 45 is chosen such that one turn of nut 48 amounts to a rotation of between 0.1° and 0.5°. The total adjusting range of the azimuth fine adjusting mechanism may amount to approximately 2°.

Some modified embodiments of elevation and azimuth adjusting mechanisms for antenna holders according to the present invention will be discussed referring to the remaining FIGS. Unless otherwise stated, any elevation adjusting mechanism can be combined with any azimuth adjusting mechanism and vice versa. Elements of these embodiments that correspond to elements already described above have the same reference numerals and are not described in detail again.

Figure 4:
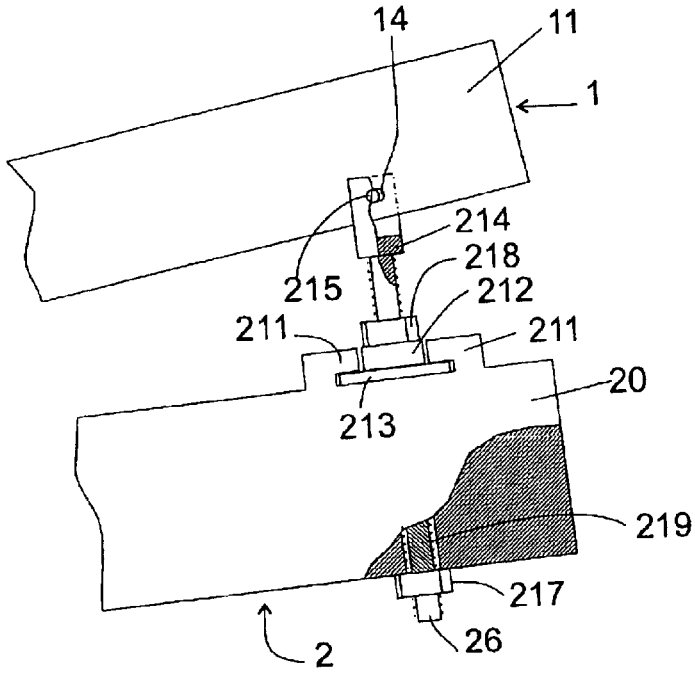
FIG. 4 shows a first modified embodiment of the elevation adjusting mechanism.

FIG. 4 is a detail of a modified elevation adjusting mechanism. The first roughly adjustable support member 2 is identical with that of FIG. 1 except for the way in which the threaded bolt 26 is mounted to the rod 20. Just as in the case of FIG. 1, the bolt extends through a bore of rod 20, which, this time, is shown in the FIG. and has the reference numeral 219. Here, the rod 20 has two claws 211 by which an adjusting nut 212 is held at the upper side of rod 20 at the end of bore 219. The adjusting nut 212 has a knurled wide diameter portion 213 that extends beyond the sides of rod 20 and can easily be held and rotated by the fingers of a user. By rotating the adjusting nut 212, the threaded bolt 26 is displaced axially.

At the upper end of threaded bolt 26, a fork 214 is formed having two fingers that extend along the lateral flanks of branch 11 and bear a bolt 215 which extends through a short slit 14 formed in branch 11.

At a lower end of threaded bolt 26, a locking nut 217 is shown. When the elevation of the antenna has been adjusted by turning adjusting nut 212, it can be fixed by turning the locking nut 217 so that the rod 20 is squeezed between the two nuts 212, 217. In order to prevent a rotation of adjusting nut 212 while doing so, the adjusting nut has a hexagonal portion 218 that may be held by a wrench.

In this embodiment, the slot 12 of FIG. 1 is not required.

In the embodiments of FIG. 1 and FIG. 4, there is a slit 14 formed in branch 11 of first finely adjustable support member 1. This slit 14 is required because, in case of FIG. 1, the cage 28 and in case of FIG. 4, the threaded bolt 26 itself is only linearly displaceable, and the radius where the arms 29 or bolt 215 engage the branch 11 may vary according to the angular orientation of the first finely adjustable support member 1. This slit 14 might be replaced by a circular hole exactly fitting the arms 29 or the bolt 215, respectively if the threaded bolt 26 were pivotably mounted at the rod 20.

Figure 5:
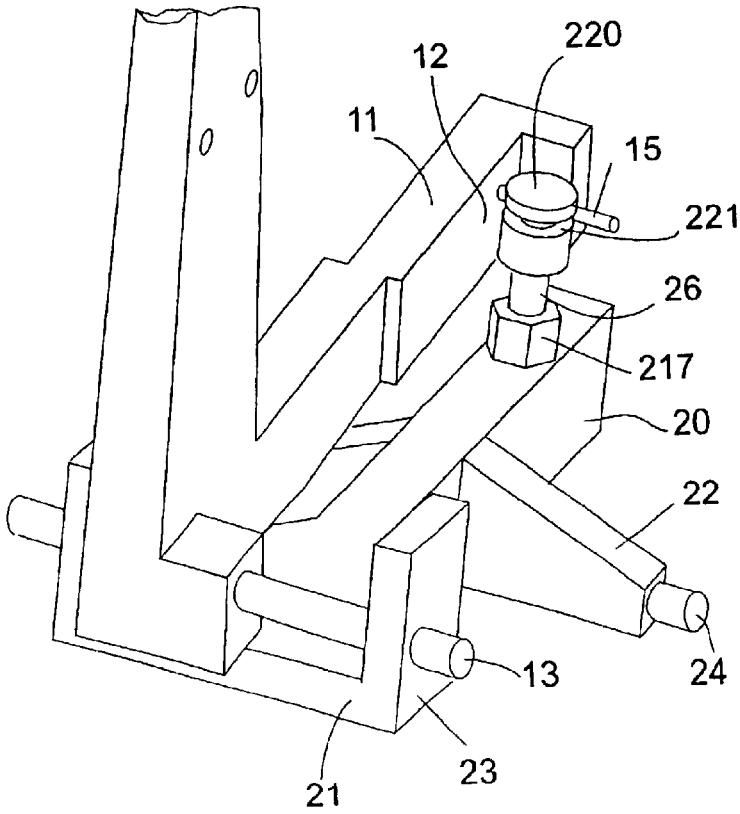
FIG. 5 shows a second modified embodiment of the elevation adjusting mechanism.

Another modified embodiment where no such slit or elongated hole is necessary is shown in FIG. 5. In this embodiment the rod 20 has a threaded bore in which the threaded bolt 26 is engaged and can be adjusted by turning around its axis. A locking nut 217 engaging threaded bolt 26 is provided at one side of rod 20, in this case at the upper side. The threaded bolt 26 has a cylindrical head portion 220 the top of which is shaped for engagement with a screwdriver. A cylindrical rod 15 held by branch 11 engages a circumferential groove 221 of this head portion. In the embodiment shown, the branch 11 has a slot 12 as shown in FIG. 1, and the rod 15 extends across this slot 12. The depth of the groove 221 is set such that while threaded bolt 26 engages the bore of rod 20, the rod 15 will never come out of the groove 221. Elevation fine tuning is done by firstly turning threaded bolt 26 using a screwdriver until a satisfying elevation value is found, and then fixing the threaded bolt 26 using the locking nut 217.

Alternatively, there might be no thread for engagement with threaded bolt 26 in the bore of adjustable member 2. In that case the threaded bolt 26 might be held using two locking nuts 212, 217, just as shown in FIG. 4.

Figure 6:
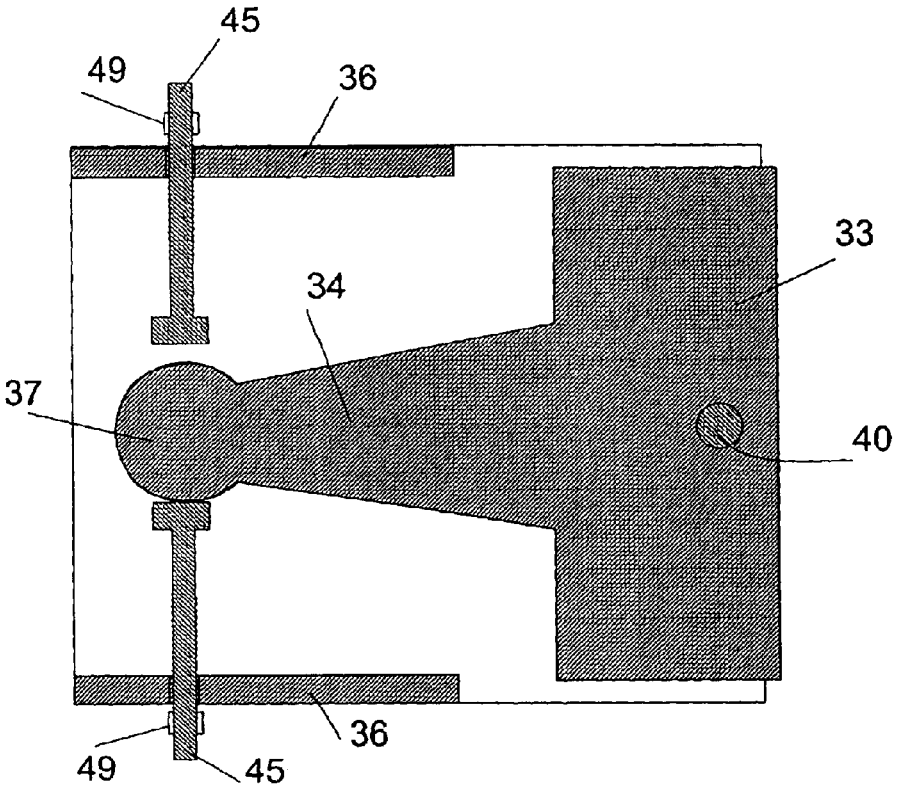
FIG. 6 shows a first modified embodiment of the azimuth adjusting mechanism.

FIG. 6 is a horizontal cross section taken along the same plane as in FIG. 3, illustrating a first modified embodiment of the azimuth adjusting mechanism. In this embodiment, there are threaded bores formed in opposing side walls 36 of base member 3. Two threaded bolts 45 extend through these bores. The bolts 45 have plate-shaped inward end portions facing each other. The projection 34 has a circular end portion 37 which is located in a space between the inward ends of the two bolts 45. The outward end of each bolt is provided with a hexagonal socket head for receiving an Allen wrench or with an equivalent structure for engaging with another type of screwdriver.

In the configuration shown in FIG. 6, there is a clearance between the circular end portion 37 and the plate-shaped end portion of one of the threaded bolts 45. In this configuration, the base member 3 is freely rotatable with respect to the pole adaptor 4 by an angle defined by said clearance. Accordingly, this embodiment allows for a first coarse azimuth adjustment when mounting the adaptor 4 on the pole 5, and a second coarse adjustment by rotating the base member 3 over the angle defined by said clearance.

For a fine adjustment, the clearance is set to zero. Then the azimuth position of the antenna is adjusted by rotating both threaded bolts 45 to the same extent and in the same direction. When the correct azimuth position has been found, the mechanism is locked by rotating the bolts 45 in opposite directions, so that the circular end portion 37 is squeezed between then. Additionally, locking nuts 49 may be placed at the outward ends of the two bolts 45.

Figure 7:
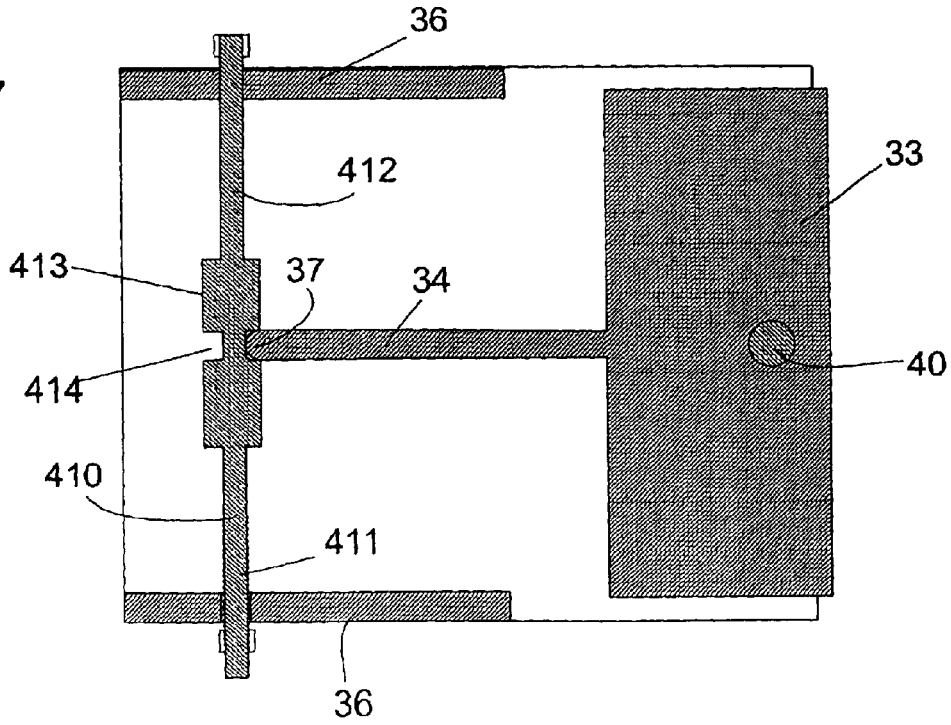
FIG. 7 shows a second modified embodiment of the azimuth adjusting mechanism.

In the embodiment of FIG. 7, the two threaded bolts 45 are replaced by a single cylindrical shaft 410 extending through both bores in the opposing side walls 36. Only one of these bores must have a thread that engages threaded first narrow portion 410 of shaft 411. A second narrow portion 412 of shaft 410 may be with or without thread. In a thick portion 413 of shaft 410 between the two narrow portions 411, 412, a circumferential groove 414 is formed. The width of this groove 414 is selected such that it will receive the circular end portion 37 of projection 34 without a clearance in the axial direction of the shaft 410.

This embodiment may be regarded as a variation of that of FIG. 6, in which the two threaded bolts 45 are combined into a single shaft, so that for carrying out the fine adjustment, it is no longer necessary to move the two bolts 45 separately.

Figure 8:
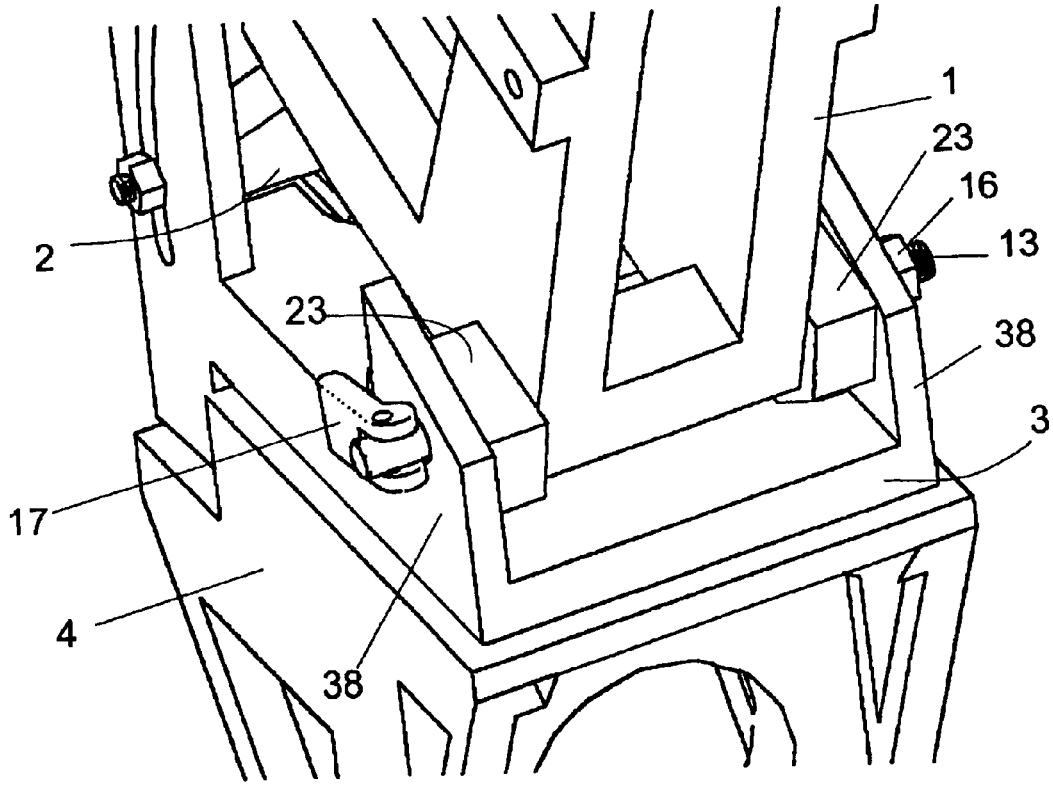
FIG. 8 shows locking means for the azimuth adjusting mechanism.

For locking the elevation adjustment of the antenna holder, an elevation position locking mechanism may be provided which is similar to the azimuth locking mechanism described above referring to FIG. 1. This elevation position locking mechanism is illustrated in FIG. 8. It comprises a locking nut 16 mounted at one end of rod 13 and an eccentric lever 17 similar to lever 44 of FIG. 1, which is mounted at the other end of rod 13 and is rotatable around an axis which is perpendicular to that of the rod 13. The rod 13 extends through vertical wings 38 of base member, through the upturned end portions 23 of crossbar 21 of the first roughly adjustable support member 2 and through the region joining branches 10, 11 of the first finely adjustable support member 1.

In the position shown in FIG. 8, the eccentric lever 17 and the locking nut 16 presses from outside against the vertical wings 38 and urges these into contact with the end portions 23. The end portions 23, in turn, are pressed against the first finely adjustable support member 1. In this way, all three elements 1, 2, 3 of the holder are in frictional engagement and cannot turn with respect to one another. When the lever 17 is raised, the vertical wings 38 and end portions 23 relax and come apart from each other, so that they can turn around rod 13 again.

Since the lever 17 and the blocking nut 16 only come into direct contact with the base member 3, the support members 1, 2 are not subject to any torque when the lever 17 is closed, so that an elevation adjustment carried out with the lever 17 open will not be accidentally destroyed when the lever 17 is closed. Accordingly, the holder can be easily and straightforwardly adjusted to a particular satellite by e.g. first performing a coarse adjustment of elevation and azimuth angles, so that a signal from the satellite is clearly detectable. Second, a fine adjustment of the azimuth angle is carried out, the azimuth adjustment mechanism is locked using lever 44, the elevation angle is finely adjusted, and finally the elevation adjusting mechanism is locked using lever 17.

What is claimed is:

1. An adjustable satellite antenna holder comprising a first base member, a first coarsely adjustable support member pivotable about a first axis with respect to the first base member, a first finely adjustable support member pivotable about an axis parallel to said first axis with respect to the first coarsely adjustable support member, a second base member, a second coarsely adjustable support member pivotable about a second axis with respect to the second base member, a second finely adjustable support member pivotable with respect to the second support member about an axis parallel to the second axis, wherein the first axis and the second axis are perpendicular and the first base member is rigidly coupled to the second finely adjustable support member.

2. A satellite antenna holder according to claim 1, wherein said first base member has a circular slot centered around its axis, and the coarsely adjustable support member that is pivotable around this axis has a threaded portion extending through this slot.

3. A satellite antenna holder according to claim 1, wherein said first coarsely adjustable support member is coupled to said first finely adjustable support member by an adjustable actuator.

4. A satellite antenna holder according to claim 3, wherein the adjusting actuator, when not driven, locks said support members relative to each other.

5. A satellite antenna holder according to claim 3, wherein said actuator comprises a male threaded member mounted to one of said support members and a female threaded member mounted to the other support member and rotatably engaging the male threaded member.

6. A satellite antenna holder according to claim 5, wherein the male threaded member is rigidly held at said one support member and the female threaded member is coupled to said other support member by an element that is displaceable with respect to the other support member in a radial direction thereof.

7. A satellite antenna holder according to claim 5, wherein said one support member comprises guiding means with respect to which the male threaded member is displaceable in a radial direction of said one support member, and said other support member comprises guiding means for guiding the male threaded member in a circumferential direction, wherein both directions are defined with respect to the axis of the two support members.

8. A satellite antenna holder according to claim 3, wherein a male threaded member forming part of said actuator has a circumferential profile rotatably engaged with one of said support members and a shaft portion in axially displaceable engagement with said other support member.

9. A satellite antenna holder according to claim 8, wherein said profile is a groove engaged with a circular cross section portion of said one support member.

10. A satellite antenna holder according to claim 8, wherein the male threaded member has a locking nut.

11. A satellite antenna holder according to claim 3, wherein said actuator comprises two male threaded members mounted in threaded bores of one of said support members with tips of said male threaded members facing each other and a trunnion of said other support member extending between the tips.

12. A satellite antenna holder according to claim 11, wherein the pitch of at least one of said threaded members is such that one turn of the at least one member corresponds to a rotation of the finely adjustable support member of less than 0.5° and, preferably, at least 0.1°.

13. A satellite antenna holder according to claim 1, wherein at least one of said axes is defined by a shaft which pivotably couples at least two of said base member and support members.

14. A satellite antenna holder according to claim 13, wherein an eccentric lever is mounted on said shaft so as to pivot between a locking position in which it urges said members into frictional engagement and an unlocking position in which said frictional engagement is released.

15. An adjustable satellite antenna holder comprising:

a first base member, a means for adjusting in elevation an antenna comprising a first coarsely adjustable support member pivotable about a first axis with respect to a second support member and a first finely adjustable support member pivotable about said first axis with respect to the first coarsely adjustable support member and a means for adjusting in azimuth said antenna comprising a second coarsely adjustable support member pivotable about a second axis with respect to the base member and said second support member that is a second finely adjustable support member pivotable with respect to the first coarsely adjustable support member, about a third axis parallel to the second axis, the first axis being perpendicular to the second axis.

16. A satellite antenna holder according to claim 15, wherein said first coarsely adjustable support member is coupled to said first finely adjustable support member by an adjusting actuator.

17. A satellite antenna holder according to claim 16, wherein said actuator comprises two male threaded member facing each other and a trunnion of said other support member extending between the tips.

18. A satellite antenna holder according to claim 16, wherein said actuator comprises a male threaded member mounted to one of said support members and a female threaded member mounted to the other support member and rotatably engaging the male threaded member.

19. A satellite antenna holder according to claim 18, wherein the male threaded member is rigidly held at said one support member and the female threaded member is coupled to said other support member by an element that is displaceable with respect to the other support member in a radial direction thereof.

20. A satellite antenna holder according to claim 18, wherein said one support member comprises guiding means with respect to which the male threaded member is displaceable in a radial direction of said one support member, and said other support member comprises guiding means for guiding the male threaded member in a circumferential directions are defined with respect to the axis of the two support members.

* * * * *